US005813548A

United States Patent [19]

Jiang

[11] Patent Number: 5,813,548

[45] Date of Patent: Sep. 29, 1998

[54] ARTICLE HOLDING NET ASSEMBLY

[76] Inventor: Ching Tzong Jiang, 527, Chung-Chie Rd., Tin-Lee Village, Hsien-See Hsiang, Changhua Hsien, Taiwan

[21] Appl. No.: 815,198

[22] Filed: Mar. 12, 1997

[51] Int. Cl.[6] ..... A47F 7/00

[52] U.S. Cl. ..... 211/85.4; 211/113

[58] Field of Search ..... 211/13, 113, 117, 211/85.4; 248/163.1, 176.1, 127; D7/602; 5/120, 129

[56] References Cited

U.S. PATENT DOCUMENTS

| | | | |
|---|---|---|---|
| 855,493 | 6/1907 | App | 248/163.2 X |
| 2,450,689 | 10/1948 | Richmond | 5/129 |
| 2,469,950 | 5/1949 | Carl | 5/129 |
| 2,563,156 | 8/1951 | Carl | 5/129 X |
| 5,113,538 | 5/1992 | Branch, III | 5/120 X |
| 5,474,188 | 12/1995 | McArdle | 211/85.4 |

*Primary Examiner*—Alvin C. Chin-Shue
*Assistant Examiner*—Sarah Purol
*Attorney, Agent, or Firm*—Bacon & Thomas, PLLC

[57] ABSTRACT

An article-holding net assembly is composed of a base, two support rods mounted uprightly on the base, and a net suspended between the two support rods. The two support rods are each provided respectively at the bottom end thereof with a ratchet which is rotatably and detachably mounted in a receiving compartment of the base. The receiving compartment has a toothed bottom wall having teeth capable of engaging and holding the teeth of the ratchet. The angles of elevation of the support rods can be adjusted to accommodate nets of various sizes.

6 Claims, 4 Drawing Sheets

ARTICLE HOLDING NET ASSEMBLY

FIELD OF THE INVENTION

The present invention relates generally to an article-holding vessel, and more particularly to an article-holding net assembly for holding food items such as fruit, bread, toast, etc.

BACKGROUND OF THE INVENTION

As illustrated in FIG. 1, an article holding net assembly of the prior art is placed on a table for holding fruit, bread, toast, and other food items. The prior art article-holding net is composed of a base A, two support rods B, and an article holding net C suspended between the two support rods B. The two support rods B are fastened respectively at the bottom end thereof with the base A and are each provided respectively with a hook B1 which is fastened at the top end of each support rod B. The net C is provided respectively at each of both ends thereof with an eye C1 engageable with the hook B1.

Such an article-holding net of the prior art as described above is disadvantageous in that the two support rods B are fixed, and the positions of the two support rods B can cannot therefore be adjusted in accordance with the length of the article holding net C.

SUMMARY OF THE INVENTION

The primary objective of the present invention is therefore to provide an improved article-holding net assembly that is free from the shortcoming of the prior art article-holding net described above.

In keeping with the principle of the present invention, the foregoing objective of the present invention is accomplished by an improved article-holding net assembly which is composed of an article-holding net, a base, and two support rods for holding the net.

The net is intended for holding the food items and is provided respectively at both opposite ends thereof with an eye engageable with a hook of a support rod so as to enable the net to be suspended between two such support rods. The support rods are each provided at the bottom end thereof with a ratchet which is mounted in a ratchet receiving recess of the base. The angle of elevation of the support rods can therefore adjusted freely in accordance with the length of the article-holding net.

The foregoing objective, features, functions, and advantages of the present invention will be more readily understood from the following detailed description of a preferred embodiment of the present invention in conjunction with the accompanying drawings.

DETAILED DESCRIPTION OF THE EMBODIMENT

Figure 1:
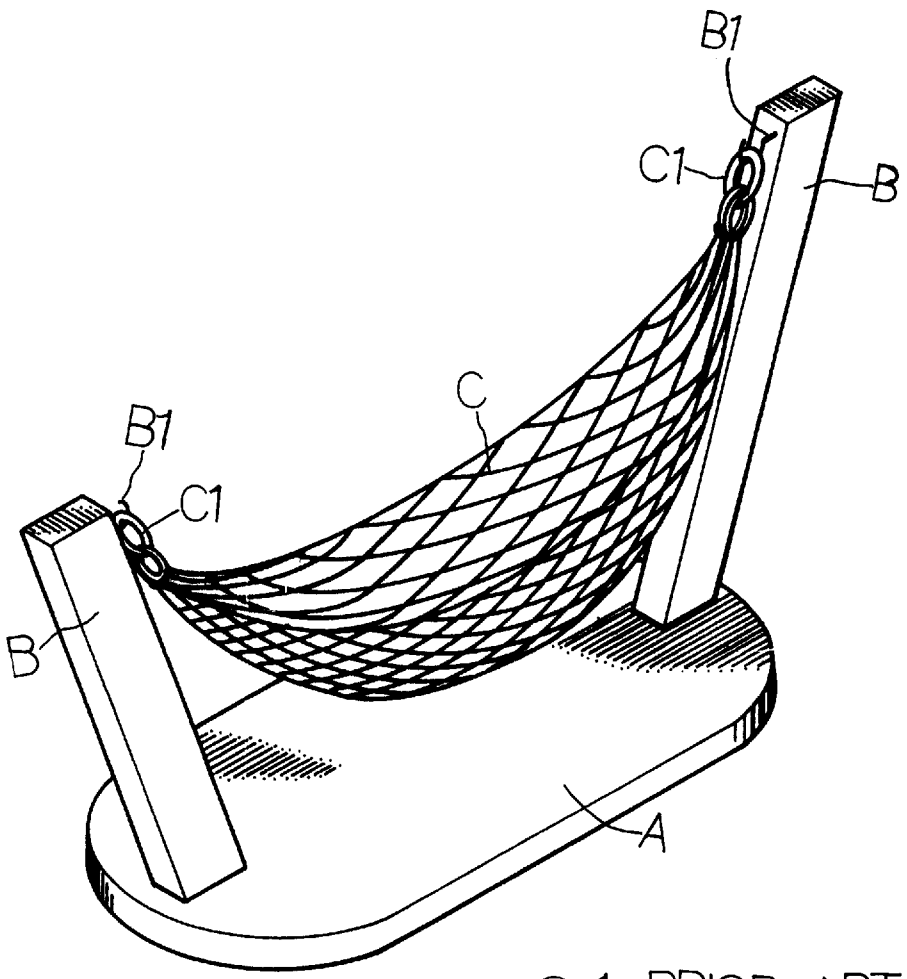
FIG 1 PRIOR ART
FIG. 1 shows a perspective view of an article-holding net assembly of the prior art.
Figure 2:
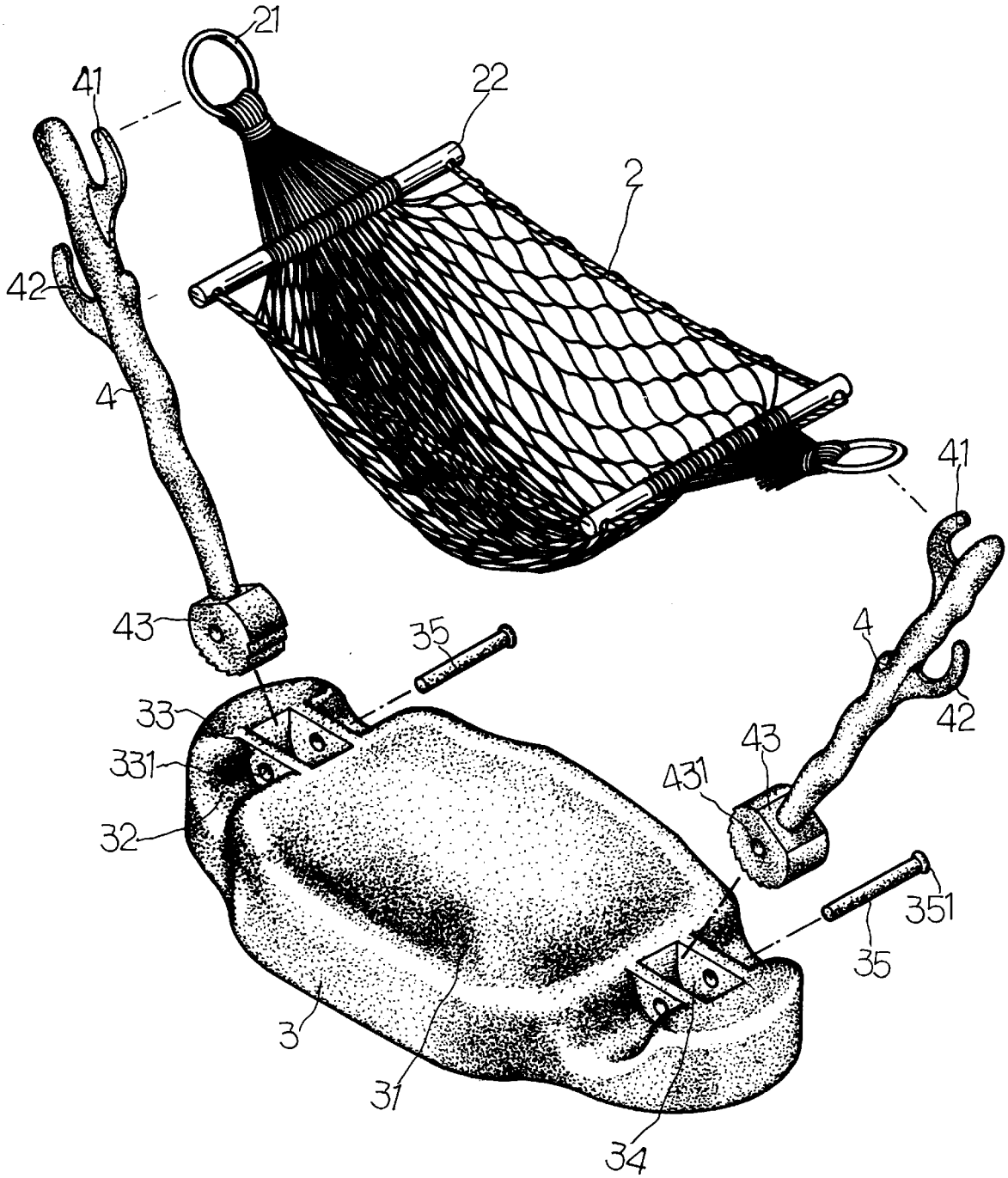
FIG. 2 is an exploded perspective view of the present invention.
Figure 3:
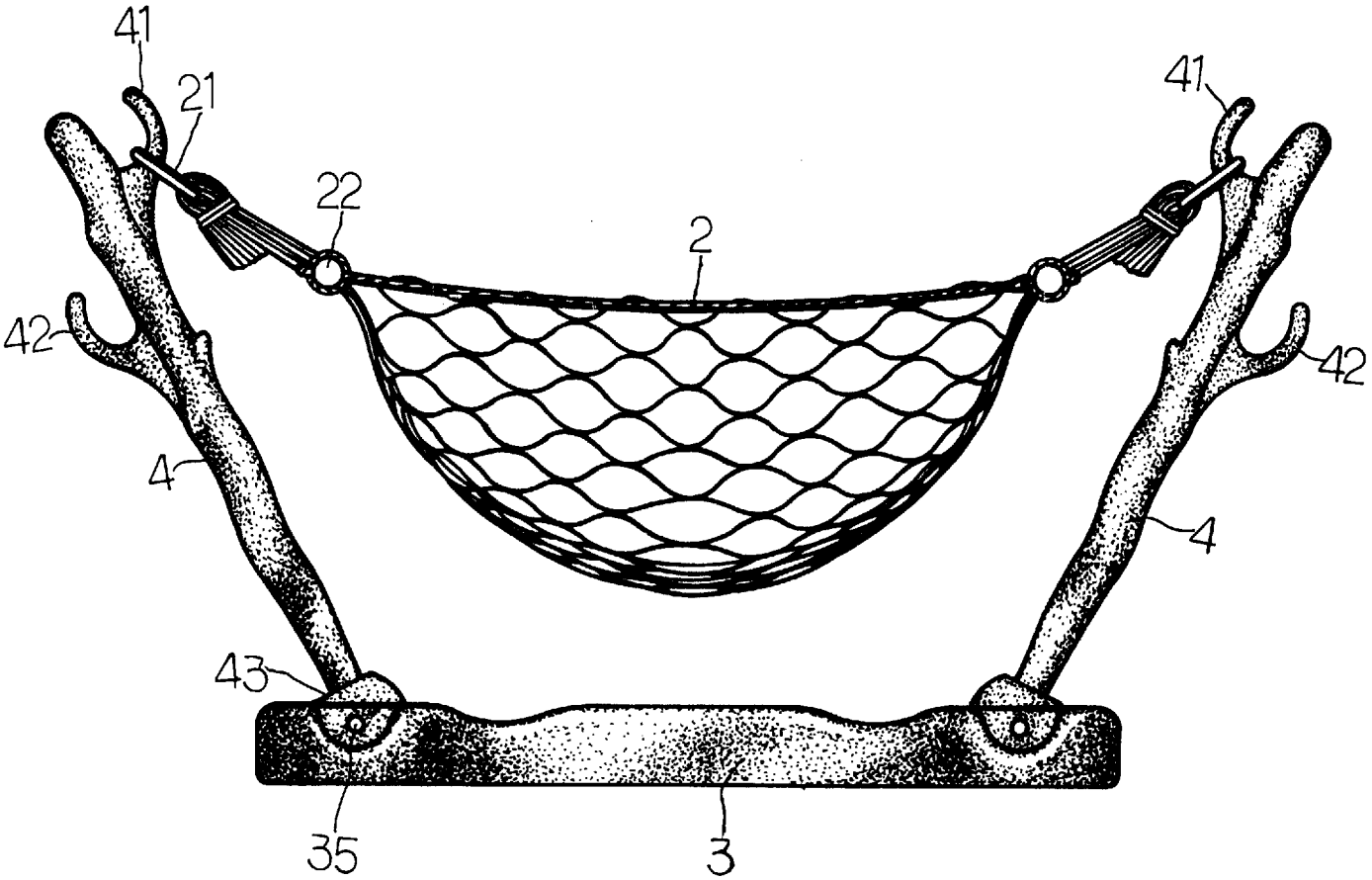
FIG. 3 is a front elevational view of the present invention in combination.

As shown in FIGS. 2–5, an article-holding net assembly embodied in the present invention is composed of an article-holding net 2, a base 3, and two support rods 4.

The net 2 is provided respectively at each of two opposite ends thereof with a bracing rod 22, and an eye 21 which is fastened with the bracing rod 22. The net 2 is suspended between the two support rods 4.

The base 3 has a curved profile for enhancing its esthetic effect. The base 3 is provided with a recessed portion 31 located under the net 2 for holding water dripped from the fruit held in the net 2. The base 3 is further provided respectively at each of both longitudinal ends thereof with a slot 32 having a ratchet receiving compartment 34. The ratchet receiving compartment 34 is defined by two side walls 33 opposite in location to each other. The ratchet receiving compartment 34 is dimensioned to receive a ratchet 43 which is fastened at the bottom end of each support rod 4. The side walls 33 each have a through hole 331. The ratchet 43 is received in the ratchet receiving compartment 34 such that the ratchet 43 is rotatably mounted on a shaft 35 which is located in the through holes 331 of the side walls 33 and a center hole 431 of the ratchet 43. The shaft 35 has a head 351 to facilitate the gripping of the shaft 35 with fingers.

The support rods 4 are fastened with the base 3 such that the two support rods 4 are opposite in location to each other, and that the angle of elevation of the two support rods 4 can be adjusted to accommodate the article-holding nets 2 of various sizes. The support rods 4 are each provided respectively at the upper segment thereof with two hooks 41 and 42, which are selectively engageable with the eye 21 of the net 2.

The teeth of each ratchet 43 and the teeth 341 in the bottom wall of each compartment are configured to only permit rotation of each ratchet 43 in an outward direction, such that support rods 4 may only be angled outwardly of base 3 during rotation of ratchets 43.

Figure 5:
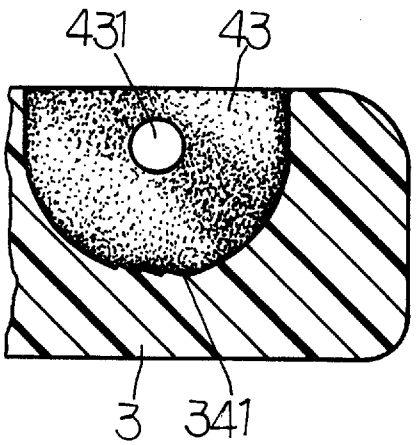
FIG. 5 shows another partial sectional view of the present invention.
Figure 4:
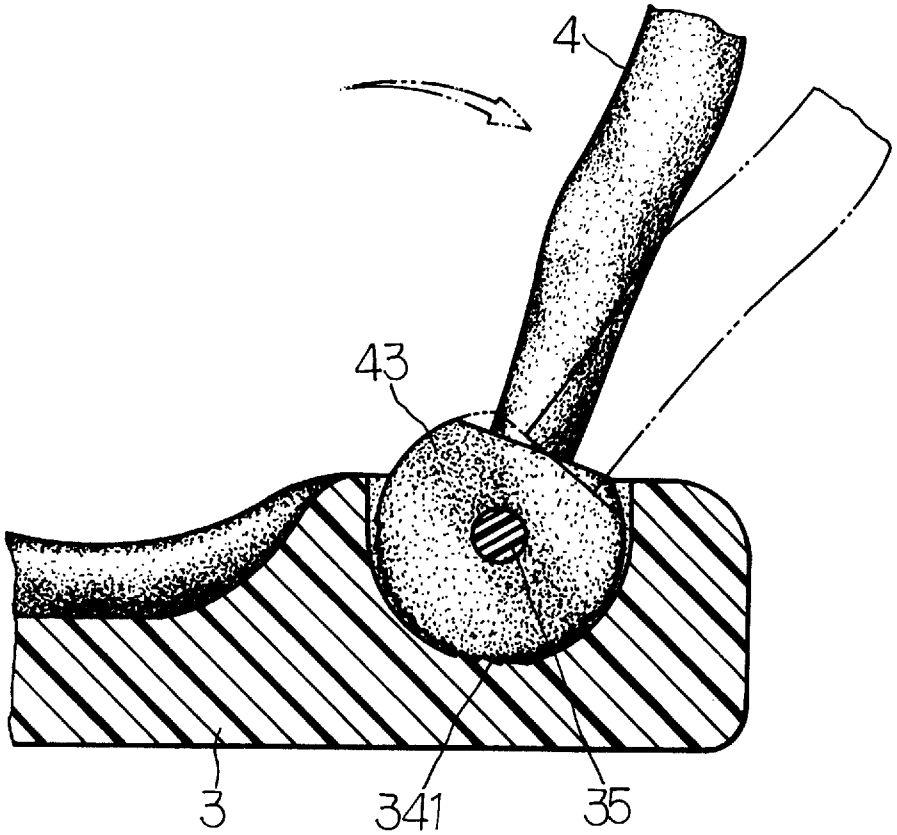
FIG. 4 shows a partial sectional view of the present invention.

It must be noted that the ratchet receiving compartments 34 of the base 3 are provided respectively in the bottom wall thereof with a plurality of teeth 341 capable of engaging and holding the teeth of the ratchet 43, as illustrated in FIGS. 4 and 5. As a result, the backward rotational movement of the ratchets 43 and the inward angling of support rods 4 are prevented after the angles of elevation of the support rods 4 are adjusted. However, the original angle of elevation of the support rods 4 can be re-established retrieved by disengaging the shafts 35 so as to allow the ratchets 43 of the support rods 4 to be replaced in their original positions inside the ratchet receiving compartment 34.

It is conceivable that the net 2 of the present invention is prone to move downwards by the weight of the food items kept in the net 2. Such a downward movement of the net 2 of the present invention can be easily corrected by changing the angle of elevation of the support rods 4 through the ratchets 43 of the support rods 4.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claim.

What is claimed is:

1. An article holding net assembly comprising:

a) a base having two opposite ends, a compartment having a toothed bottom wall at each opposite end;

b) a pair of support rods, each support rod including a bottom end having a ratchet wheel fastened thereto, each ratchet wheel being rotatably mounted in a compartment of the base and disposed in engagement with the toothed bottom wall thereof, the configurations of each toothed bottom wall and its engaged ratchet wheel permitting rotational movement of the ratchet wheel in only an outward direction so that the support rods may only be angled outwardly with respect to the base, each support rod further including an upper segment provided with a first hooking means; and c) a net having two opposite ends, each opposite end including a bracing bar and a second hooking means, and the second hooking means being engageable with the first hooking means for suspending the net between the support rods.

2. The assembly of claim 1 wherein each compartment includes a pair of opposite side walls having a pair of aligned holes therethrough, each ratchet wheel includes a hole therethrough, and a shaft engageable through the holes of the side walls of each compartment and each ratchet wheel for rotatably mounting the ratchet wheel within the compartment.

3. The assembly of claim 1 wherein each opposite end of the base further includes a slot formed therein and each compartment is located within the slot.

4. The assembly of claim 1 wherein the ratchet wheels are detachably mounted within the compartments of the base.

5. The assembly of claim 1 wherein the ratchet wheels each includes a plurality of teeth disposed in engagement with the teeth of the bottom walls of the compartments.

6. The assembly of claim 1 wherein the base further includes an upper surface having a recessed portion formed therein, and the recessed portion being positioned below the net for collecting liquid from an article held in the net.

* * * * *